US006127881A

United States Patent [19]

Tsay et al.

[11] Patent Number: 6,127,881

[45] Date of Patent: Oct. 3, 2000

[54] MULTIPLIER CIRCUIT

[75] Inventors: Ching-yuh Tsay; Henry Tin-Hang Yung, both of Richardson, Tex.

[73] Assignee: Texas Insruments Incorporated, Dallas, Tex.

[21] Appl. No.: 08/251,053

[22] Filed: May 31, 1994

[51] Int. Cl.[7] ..... G05F 3/02

[52] U.S. Cl. ..... 327/538; 327/73; 327/87

[58] Field of Search ..... 327/52, 54, 56, 327/67, 73, 87, 323, 363, 563, 534, 535, 538, 540

[56] References Cited

U.S. PATENT DOCUMENTS

| | | | |
|---|---|---|---|
| 4,986,385 | 1/1991 | Masaki . | |
| 5,051,686 | 9/1991 | Schaffer | 323/313 |
| 5,063,304 | 11/1991 | Iyengar | 307/296.6 |
| 5,087,834 | 2/1992 | Tsay | 307/443 |
| 5,103,159 | 4/1992 | Breugnot et al. | 323/315 |
| 5,120,993 | 6/1992 | Tsay et al. | 307/296.4 |
| 5,159,206 | 10/1992 | Tsay et al. | 307/272.3 |
| 5,168,209 | 12/1992 | Thiel | 323/313 |
| 5,220,534 | 6/1993 | Redwine et al. | 365/226 |
| 5,233,161 | 8/1993 | Farwell et al. | 219/209 |
| 5,311,319 | 5/1994 | Monoi | 327/73 |

*Primary Examiner*—Jung Ho Kim
*Attorney, Agent, or Firm*—W. Daniel Swayze, Jr.; W. James Brady, III; Frederick J. Telecky, Jr.

[57] ABSTRACT

A multiplier circuit multiplies a reference voltage to increase the level of the reference voltage. A feedback circuit of the multiplier circuit stabilize the multiplier circuit such that a feedback voltage of said feedback circuit tends to equalize the reference voltage. The feedback circuit is free from capacitance which would unstabilize the feedback circuit. A voltage divider outside of the feedback circuit reduces the multiplied voltage of the multiplier circuit.

8 Claims, 3 Drawing Sheets

MULTIPLIER CIRCUIT

TECHNICAL FIELD OF THE INVENTION

This invention relates to voltage multiplier and more particularly to multiplier of reference voltage such as used in integrated circuits.

BACKGROUND OF THE INVENTION

The development of VLSI semiconductor devices of the dynamic random access memory (DRAM) type is well known. Over the years, the industry has steadily progressed from the DRAMS of the 16K type (as shown in U.S. Pat. No. 4,181,701) to DRAMS of the 64K type (as shown in U.S. Pat. No. 4,055,444) to DRAMS of the 1MB type as shown in U.S. Pat. No. 4,658,377 and progressed to DRAMS of the 4MB type. The 16MB DRAM, wherein more that 16 million memory cells are contained on a single semiconductor chip is another generation of DRAMS to be produced.

In designing VLSI semiconductor memory devices of the 16MB DRAM type, designers are faced with numerous challenges. One area of concern is power consumption. The device must be able to power the increased memory cells and the supporting circuits. However, for commercial viability, the device must not use excessive power. The power supplies used and the burn in voltage for the device must also be compatible with the thin gate oxides in the device.

Another area of concern is the elimination of defects. The development of larger DRAMS has been fostered by the reduction in memory cell geometries such as illustrated by U.S. Pat. No. 4,240,092 and U.S. Pat. No. 4,721,987. The extremely small geometries employed by the 16MB DRAM is manufactured using sub-micron technology. The reduction in feature size has meant that particles that previously did not cause problem in the fabrication process, now can cause circuit defects and device failures.

In order to ameliorate defects, redundancy schemes have been introduced. The redundancy schemes normally consist of a few extra rows and columns of memory cells that are placed within the memory array to replace defective rows and columns of memory cells. Designers require new and improved redundancy scheme in order to effectively and efficiently repair defects and thereby increase the yields of the 16MB DRAM chips.

Another area of concern is testing. The device must have circuits to allow for industry standard X16 parallel tests. In addition, other circuits and test schemes are needed for internal production use to verify operability and reliability.

The options that device should have is another cause for concern. For instance, some customers require a X1 device, while others require a X4 device. Some require an enhanced page mode of operation.

Another cause for concern is the physical layout of the chip. The memory cells and supporting circuits must fit on a semiconductor chip of reasonable size. The size of the package device must be acceptable to buyers.

New design strategies and circuits are required to meet the above concerns, and other concerns relating to the development of the dynamic random access memory devices.

FIG. 1 illustrates a multiplier circuit 200. The multiplier circuit includes two stages, namely a comparator stage 202 and multiplier stage 204. FIG. 1 illustrates a multiplier circuit to achieve an output voltage represented by $V_{OUT}$ of 3.3 volts. Since the reference voltage, $V_{ref}$, is approximately 1.25 volts, the output voltage $V_{OUT}$, across resistors 208 and 210, is 3.3 volts. As the ratio of $V_{OUT}/V_{ref}$ is not an integer, this ratio may be produced by a voltage divider through a resistor string. However, one problem with such a multiplier used with DRAMS is that these resistors of the multiplier are constantly conducting and the multiplier is constantly using current. One object of designers of the DRAM voltage multiplier is to minimize this constant current in order to save power. One method of reducing this stand-by current is to increase the resistance of resistors 208 and 210 by increasing the layout area, resulting in a resistor that is long and narrow. However, a disadvantage of a long and narrow resistor is the associated parasitic capacitance. The parasitic capacitance, illustrated in FIG. 1 by capacitors 206 and 212 affect the feedback circuit of FIG. 1 adversely by introducing additional phase shifts resulting in circuit instability. If the feedback circuit is unstable, any small noise which maybe introduced is amplified, and the feedback circuit tends to oscillate by the amplification of this noise.

SUMMARY OF THE INVENTION

The present invention provides a multiplier circuit having a feedback path free from capacitance which would destabilize the feedback circuit of the multiplier circuit.

The present invention eliminates the supply slew problem of a Miller-type compensated feedback operational amplifier circuit by controlling the maximum rate which the output voltage of the operational amplifier changes for either a square wave or step supply slew by using output compensated feedback circuits.

DESCRIPTION OF THE DRAWINGS

These and other features of the invention will be apparent to those skilled in the art from the following detailed description of the invention, taken together with the accompanying drawings in which.

DETAILED DESCRIPTION OF THE INVENTION

The present invention and its advantages are illustrated by referring to FIGS. 1–7, like numerals being used for like and corresponding parts of the various drawings.

Figure 1:
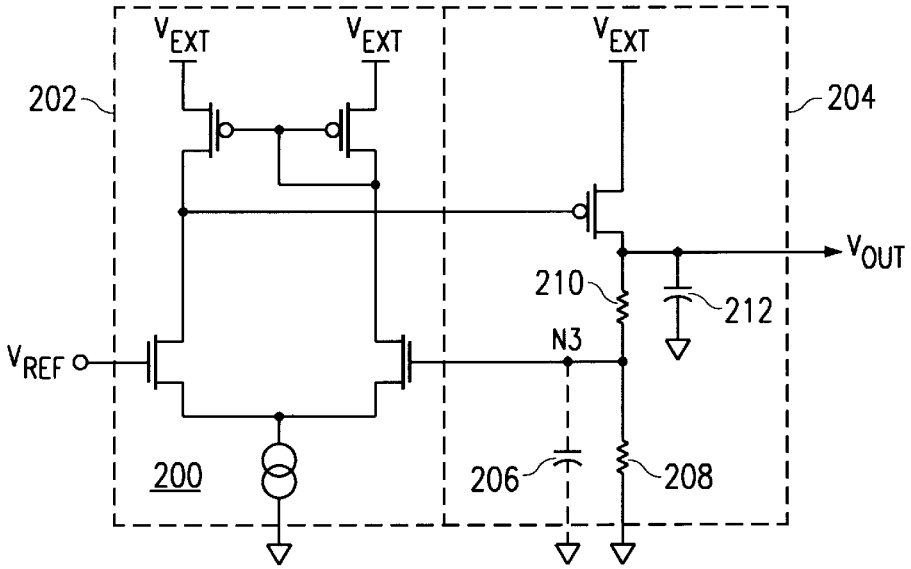
FIG. 1 (PRIOR ART)
FIG. 1 is a circuit diagram of multiplier circuit with capacitance within the feedback circuit.
Figure 2:
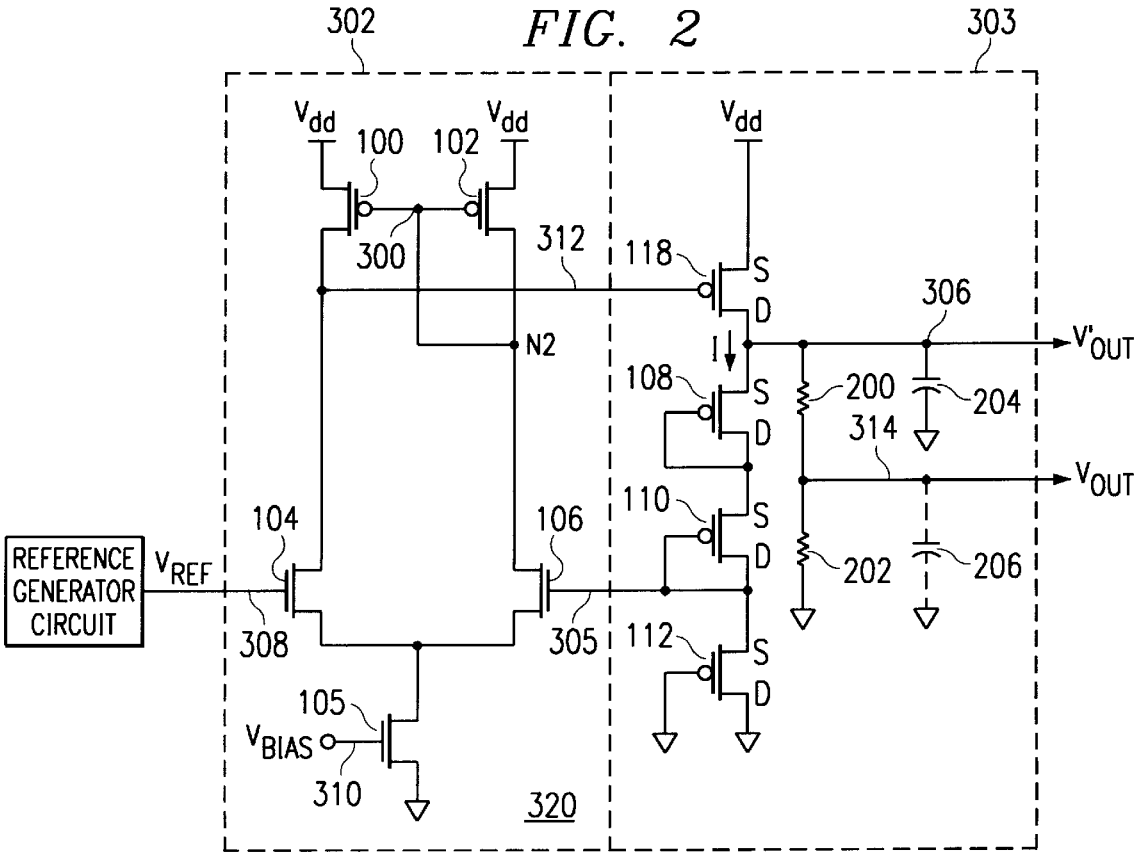
FIG. 2 is a circuit diagram of a multiplier with no capacitance which would adversely affect the stability of the feedback circuit of the present invention.

As illustrated in FIG. 2, a comparator 302 of the multiplier circuit 320 is configured with the N-channel MOS differential amplifier of transistors 106 and 104 having a current mirror active load of P-channel transistors 100 and 102. Comparator 302 drives node 312 with a voltage depending upon the level of $V_{ref}$ relative to the level of node 305. Node 305 is connected to comparator 302 by its connection to the gate of N-channel transistor 106 to provide feedback to comparator 302. N-channel transistor 104 has its gate connected to node 308 to provide the reference voltage $V_{ref}$ to comparator 302. Node 310 is connected to voltage $V_{bias}$ and is connected to the gate of N-channel transistor 105, which has a drain of transistor 105 connected to the sources of transistors 106 and 104, and has a source of transistor 105 connected to ground. P-channel transistor 102 has its source biased at the $V_{dd}$ and has its drain connected to the drain of transistor 106. Similarly, P-channel transistor 100 has its source biased at $V_{dd}$ and has its drain connected to the drain of transistor 104. The gates of transistors 102 and 100 are connected to the drains of transistor 102 and 106. The drains of transistors 100 and 104 are connected to node 312, which controls the gate of P-channel transistor 118.

In operation comparator 302 is enabled by node 310 by the voltage $V_{bias}$ being at DC biasing level larger than the threshold voltage of N-channel transistor, $V_{TN}$. With node 310 higher than $V_{TN}$, transistor 105 is turned on and acts as a current source to ground. The sources of transistors 104 and 106 are pulled by transistor 105 to a voltage which is an N-channel threshold voltage $V_{TN}$ below the gate voltages of 104 and 106 (for example with respect to $V_{ref}$). This allows transistors 104 and 106 to be conductive/responsive to voltages applied to their respective gates, enabling the operation of comparator 302 to be responsive to the voltage on node 305 from voltage divider 303 by adjusting the voltage at node 312. As noted above, transistor 105 acts as a current source in comparator 302. As input voltage to node 308 ($V_{ref}$) is below voltage of node 305, transistor 106 will become more conductive than will transistor 104 due to the voltage of node 305 being higher than node 308 as a result of the matching of size of transistors 104 and 106. Accordingly, the bulk of the current through the source of transistor 105 will be drawn by transistors 102 and 106 rather than by transistors 100 and 104. In order to satisfy the transistor current-voltage relationships, the high current passing through transistor 102 relative to transistor 100 will cause the voltage at the drain of transistor 100 to rise toward $V_{dd}$ and will cause the voltage at the drain of transistor 102 to fall toward ground. With the drains of transistors 100 and 104 at node 312 rising toward $V_{dd}$, transistor 118 will become less conductive, pulling node 305 toward ground. As node 305 is pulled toward ground, transistor 106 will tend to conduct less current. This in turn will draw less current through transistor 102 and more through transistor 100 which in turn will cause the voltage at the drains of transistor 100 and 104 at node 312 to fall toward ground as the current through these transistors are raised. Transistor 118 becomes more conductive with the lower voltage at node 312 and as discussed above, and it is preferable that transistors 104 and 106 be closely match to one another and that transistors 100 and 102 also be closely matched to one another. With that matching of the transistor pairs, the operation of comparator 302 will tend toward a point where the current passing through transistors 104 and 100 will match the current passing through transistors 106 and 102, with the gate to source voltages of transistors 104 and 106 becoming equal. Accordingly, comparator 302 will be in a steady state, reaching the operation where the voltage at node 308 is equal to the voltage at node 305. The source coupled pair transistors 104 and 106 compare the voltage of node 308 and node 305. Differential voltages cause differential current flows in transistors 104 and 106. Thus, varying the potential at node 312. For example, as the voltage at node 308 is higher than the voltage at node 305, the current in transistors 100 and 104 increases. As the current increases, the voltage at node 312 drops lower. Thus, node 312 is used as a feedback to correct the potential at node 305. As the voltage at node 312 drops, the voltage at node 305 increases to match the voltage at node 308.

Voltage divider 303 is connected to comparator 302 through common nodes 312 and 305. The source of P channel transistor 118 is biased at the voltage level of $V_{dd}$ while the gate of transistor 118 is connected to 312 and the drain of transistor 118 is connected to node 306, which is connected to the source of P channel transistor 108. The gate and drain of transistor 108 is connected to the source of P-channel transistor 110. The gate and drain of transistor 110 is connected to node 305, which is connected to the source of P-channel transistor 112. The gate and drain of transistor 112 is connected to ground potential. In order to achieve a non-integer reduction in the voltage, a resistor string may be employed. Resistor 200 is connected to the transistor 118 and the source of transistor 108 to reduce the voltage at node 306. Resistor 202 is connected to resistor 200 to ground to reduce the voltage at node 306. Associated with resistors 200 and 202 is parasitic capacitor 206. Further, a compensation capacitor 204, with additional parasitic capacitance introduced by resistors 200 and 202, is connected to resistor 200 in order to stabilize the multiplier circuit 320. The voltage at node 314 is the resistance of resistor 202 divided by the sum of resistance of resistors 200 and 202 multiplied by the voltage at node 306. Thus, by varying the resistance of resistors 200 and 202 any non-integer voltage reduction can be produced.

In operation, as the difference between the voltage $V_{dd}$ and the voltage at node 312 exceeds the absolute value of the P-channel threshold voltage, $V_{TP}$, the transistor 118 becomes conductive. Since the gate and drain of transistors 108, 110 and 112 are connected together respectively, and transistor 118 is conducting; $V_{dd}$ minus source to drain voltage, $V_{SD}$, of transistor 118 is applied to transistors 108, 110 and 112. Each of these transistors 108, 110 and 112 will have a voltage between the source and drain, $V_{SD}$, of the respective transistors. The voltage $V_{SD}$ of transistor 118 is related to the voltage at the gate of transistor 118. As the voltage of node 305 rises above a predetermined $V_{ref}$, the voltage at the gate of transistor 118 is increased, increasing the voltage of $V_{SD}$ of transistor 118. This decreases the voltage at node 305 to match the predetermined $V_{ref}$. If the voltage of node 305 falls below $V_{ref}$, the voltage at the gate of transistor 118 is lowered, lowering the voltage of $V_{SD}$ of transistor 118. This increases the voltage at node 305 to match $V_{ref}$. The voltage, $V'_{OUT}$, at node 306 is now 3 times $V_{ref}$ as a result of voltage drops across transistors 108, 110 and 112. The result is achieved by transistors 108, 110 and 112 being well matched in terms of width and length. The voltage at node 314, $V_{OUT}$, is a ratio of the resistance of resistor 202 divided by the sum of the resistance of resistors 200 and 204 multiplied by the voltage $V'_{OUT}$, to achieve a desired voltage level based on the 3 times $V_{ref}$. The above described invention solves both the slew problem while achieving a variable ratio of input to output voltages and provides a circuit that uses minimal standby current.

The feedback of the comparator 302 is achieved by the use of P channel transistors. Unlike the resistors which are formed from long narrow channels, these transistors do not have a large amount of parallel parasitic capacitance which affects the feedback of the comparator 302.

FIG. 2 further illustrates the compensation capacitance 204 and the parasitic capacitance 206 associated with resistor 202. The parasitic capacitor 206 is not in the feedback circuit of the comparator 302. As a consequence, the comparator 302 does not suffer from stability problem, yet provides a variable ratio of output voltages.

Figure 3:
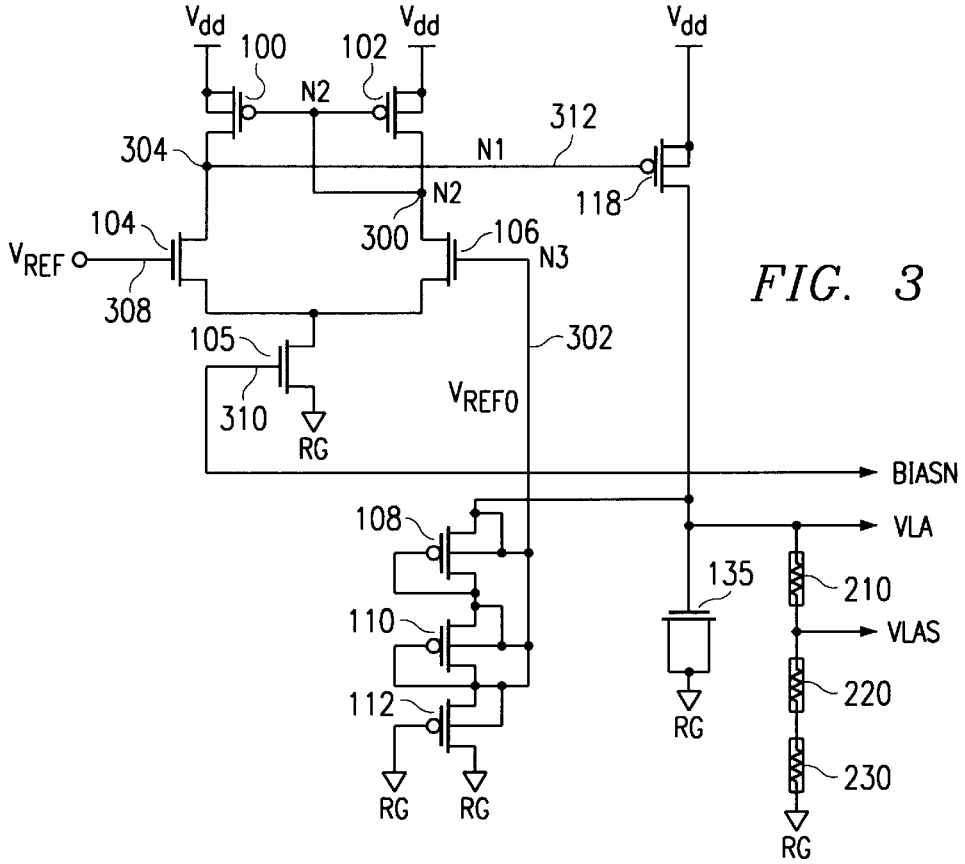
FIG. 3 is a circuit diagram of a multiplier circuit of another embodiment of the present invention without capacitance within the feedback circuit.

Now turning to FIG. 3, an additional embodiment of the present invention is illustrated.

Transistor 100 and transistor 102 may have a length to width ratio of 10 to 1.2 microns while transistors 104 and 106 may have a length to width ratio of 10 to 2 microns. Transistor 105 may have a length to width ratio of 45 to 10 microns. The length to width ratio of transistors 108, 110 and 112 may be 3 to 30. Capacitor 135 connected to the source of transistor 108 and to ground may be a P-type transistor with length to width ratio of 27,000 to 10 microns. FIG. 3 illustrates resistors 210, 220 and 230 connected between node 310 and ground to provide a series of tabs for different voltages. Although not illustrated, each of resistors 210, 220 and 230 have corresponding parasitic capacitance.

Figure 4:
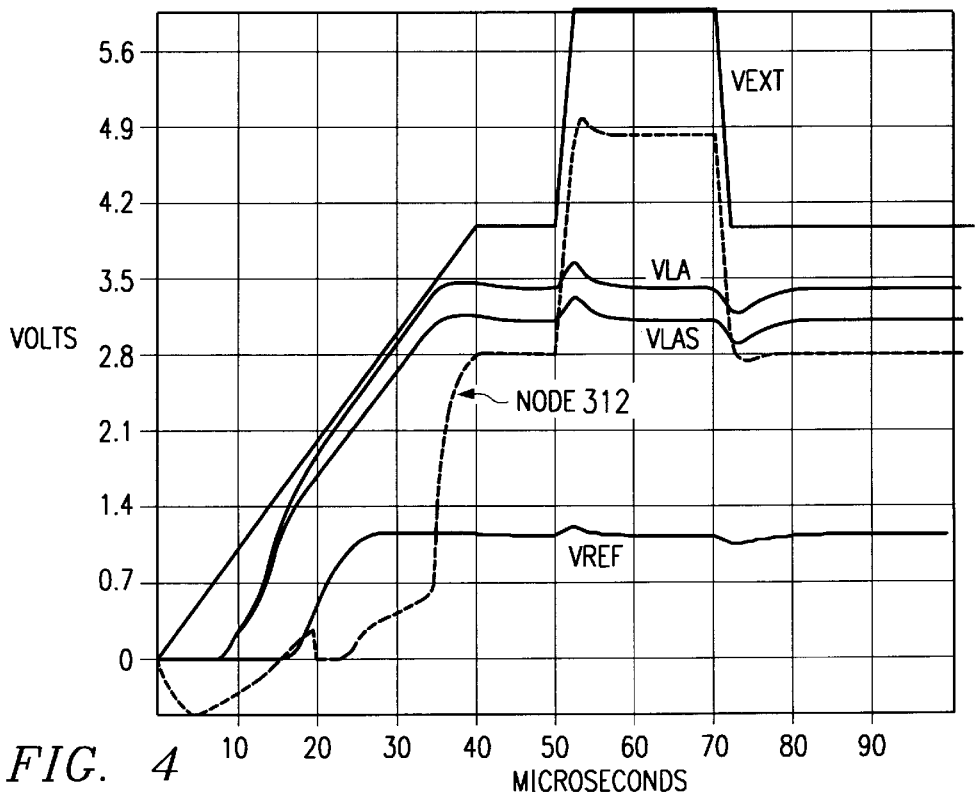
FIG. 4 illustrates the relationship between volts and microseconds illustrating the slew performance of the present invention.

Referring now to FIG. 4, FIG. 4 illustrates the improvements to the slew problem. FIG. 4 illustrates that at approximately 50 milliseconds the $V_{EXT}$ increases rapidly from 4 to 6 volts. The voltage at node 312 closely follows the $V_{EXT}$ step, resulting in little or no differential current in transistor 118. With additional help from capacitor 135, the result is little or no slew on $V_{LA}$ and $V_{LAS}$. Furthermore, little or no slew is illustrated when the voltage drops at 70 microseconds.

Figure 5:
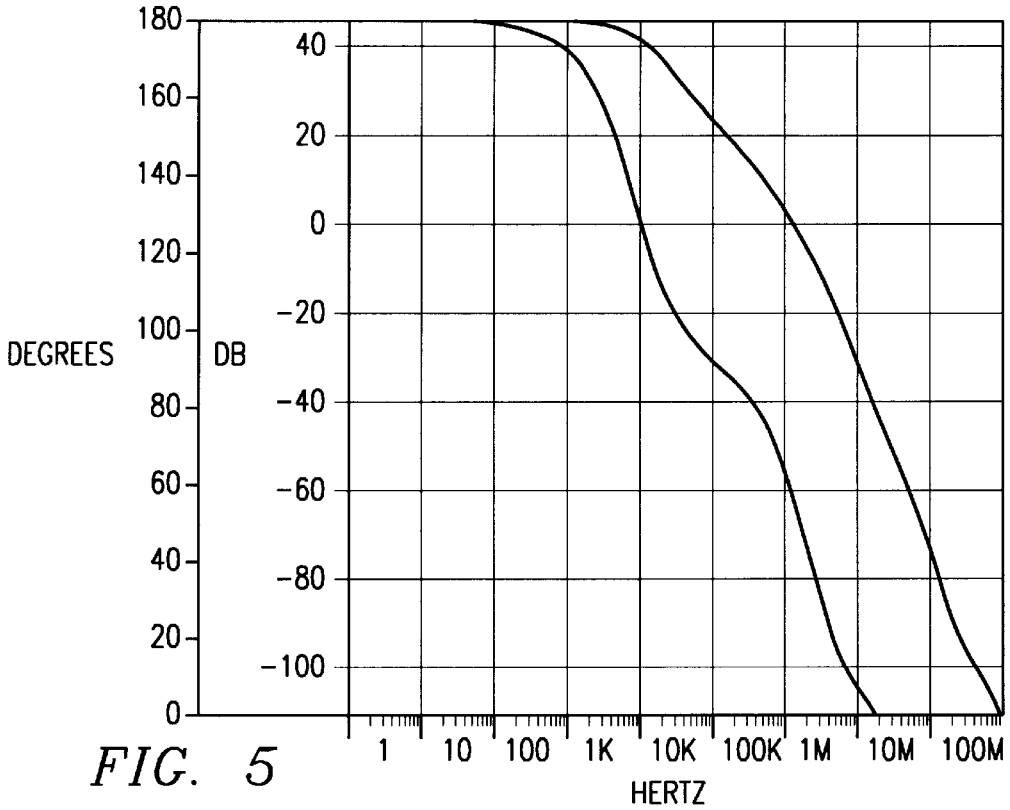
FIG. 5 is a diagram illustrating the relationship between frequency and phase shift of the present invention.

FIG. 5 illustrates a Bode plot of the phase response of the open-loop configuration of the feedback circuit. FIG. 5 illustrates that the resulted circuit has more than 56 degrees of phase margin.

Figure 6:
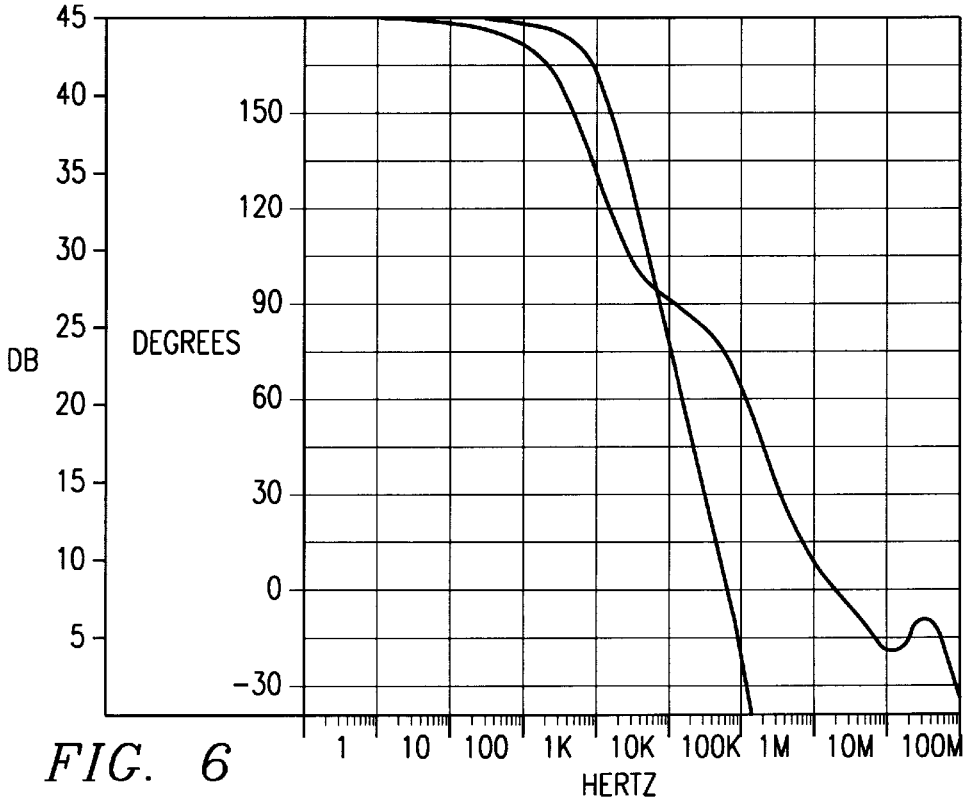
FIG. 6 illustrates the relationship between frequency and gain of the present invention.

FIG. 6 illustrates a Bode plot of the gain response of the open-loop configuration of the feedback circuit. FIG. 6 illustrates the resulted circuit has more than 40 DB gain margin.

OTHER EMBODIMENTS

Although the present invention and its advantages have been described in detail, it should be understood that various changes, substitutions and alterations can be made herein without departing from the spirit and scope of the invention as defined by the appended claims.

What is claimed is:

1. A memory device having a multiplier circuit, comprising:

a reference generator circuit for producing a reference voltage;

said multiplier circuit coupled to said reference generator circuit for increasing a level of the reference voltage to a multiplied voltage wherein, said multiplier circuit has a feedback circuit connected to said reference generator circuit to stabilize the multiplier circuit such that a feedback voltage of said feedback circuit substantially equals said reference voltage;

said feedback circuit being free from capacitance to stabilize said feedback circuit of said multiplier circuit; and a voltage divider coupled to the feedback circuit to reduce said multiplied voltage of said multiplier circuit.

2. A memory device having a multiplier circuit as in claim 1, wherein said feedback circuit includes a transistor to generate a smaller voltage than said multiplied voltage of said multiplier circuit.

3. A memory device having a multiplier circuit as in claim 2, where said transistor is a P-channel transistor to generate said smaller voltage from said multiple voltage of said multiplier circuit.

4. A memory device having a multiplier circuit as in claim 2, wherein said feedback circuit includes an additional transistor to generate an additional reduced voltage from said multiplied voltage of said multiplier circuit.

5. A memory device having a multiplier circuit as in claim 4, wherein said additional transistor is a P-channel transistor to generate said additional reduced voltage from said multiplied voltage of said multiplier circuit.

6. A memory device having a multiplier circuit as in claim 1, wherein said voltage divider circuit includes a first resistor and a second resistor connected in series to reduce said multiplied voltage of said multiplier circuit and connected to feedback circuit.

7. A memory device having a multiplier circuit as in claim 6, wherein said first resistor and said second resistor have parasitic capacitance associated with said first and second resistor.

8. A memory device having a multiplier circuit, comprising:

a reference generator circuit for producing a reference voltage;

said multiplier circuit coupled to said reference generator circuit for increasing a level of the reference voltage to a multiplied voltage wherein, said multiplier circuit has a feedback circuit to stabilize the multiplier circuit such that a feedback voltage of said feedback voltage of said feedback circuit substantially equals said reference voltage;

said feedback circuit including only transistors; and a voltage divider coupled to the feedback circuit to reduce said multiplied voltage of said multiplier circuit.

* * * * *